United States Patent [19]
Barthe et al.
[11] 4,290,490
[45] Sep. 22, 1981

[54] ROOF BOLTING DEVICE

[75] Inventors: Henry P. Barthe, Pittsburgh; William R. Cobb, Murrysville, both of Pa.

[73] Assignee: Schroeder Brothers Corporation, McKees Rocks, Pa.

[21] Appl. No.: 30,219

[22] Filed: Apr. 16, 1979

[51] Int. Cl.³ ..... E21C 11/02; E21C 27/22; E21D 20/00

[52] U.S. Cl. ..... 173/23; 173/36; 173/52; 173/147; 175/219; 299/33

[58] Field of Search ..... 173/23, 36, 38, 147, 173/52; 175/219, 315; 299/11, 33; 405/291

[56] References Cited

U.S. PATENT DOCUMENTS

| | | | |
|---|---|---|---|
| 2,832,567 | 4/1958 | Fletcher et al. | 173/23 X |
| 3,141,511 | 7/1964 | O'Leary | 173/147 X |
| 3,768,574 | 10/1973 | Long | 173/23 |
| 3,842,610 | 10/1974 | Willis et al. | 173/38 X |
| 3,865,197 | 2/1975 | McCormick | 173/23 |
| 3,939,958 | 2/1976 | Pyles | 299/11 X |
| 3,951,215 | 4/1976 | Galis | 173/23 |
| 3,995,905 | 12/1976 | Jamison | 299/11 |
| 4,079,792 | 3/1978 | Paul et al. | 173/23 |
| 4,108,253 | 8/1978 | Woodford | 173/23 |
| 4,157,878 | 6/1979 | Jamison | 173/23 X |
| 4,172,615 | 10/1979 | Hakes | 173/27 X |

*Primary Examiner*—Robert Mackey
*Attorney, Agent, or Firm*—Webb, Burden, Robinson & Webb

[57] ABSTRACT

A roof drilling and bolting device comprising a mobile chassis and two cabs mounted to the front of the chassis for independent transverse (outward to the side) movement. The cabs have floors and protective canopies. Extensible hydraulic devices position the cabs outwardly of the chassis. Other extensible hydraulic devices raise and lower the cabs relative to the chassis. Mounted to the front of each cab is a drilling assembly including a rectilinear positioning device for drill pods which provides up-down and side-to-side movement of the drill pod in front of the cab. An extensible standard is positioned by a boom which extends forward of the chassis to provide a temporary roof support.

6 Claims, 4 Drawing Figures

ROOF BOLTING DEVICE

BACKGROUND

Roof drilling and bolting is a well known process for maintaining the integrity of mine roofs; in other words for preventing the collapse of the roof. Special machines have been developed for assisting in the roof drilling and bolting process (hereafter the "roof bolting" process). See, for example, U.S. Pat. Nos. 3,252,525; 3,375,880; 3,768,574; 3,842,610; 3,951,215; 4,050,259; and 4,079,792. In a typical roof bolting process, a bore is drilled upwardly into the roof a distance depending upon the nature of the overburden. Thereafter, a self-anchoring bolt is turned up into the bore to compress the roof (ceiling) adjacent the bore and the bolt. In some practices, the bolt is secured in the bore with epoxy cement. The applicants' roof bolting device differs from those disclosed in the prior art in having a unique configuration which enables two driller operators to always remain under protective canopies while tramming into position and drilling or bolting. Further, the unique configuration will encourage the operators to use the machine exactly as intended. Prior machines, while in theory designed for safety, often fail to make it more convenient and comfortable for the operators to remain under a protective canopy at all times.

In a mine passageway of typical width, say 15 to 20 feet, it is desirable to place roof bolts transversely spaced across the passage to within about 2 to 4 feet of the side walls. Most efficient roof bolting will take place with a minimum of chassis positioning and repositioning. Applicants provide a roof bolting device that enables two operators to work opposite sides of a mined passageway from cabs transversely positionable independently of one another. Hence, the chassis which is, say 9 feet wide, may be moved down the center of the passageway and, without further repositioning roof bolts can be placed out to 6.5 feet from the center line of the chassis (also the center line of the passageway) on both sides.

It is an advantage of the device set forth herein that two canopy covered cabs are independently movable transversely of the center line of the chassis. Each cab has its own controls for cab positioning relative to the chassis and each cab has its own controls for positioning the associated drill pod relative to the cab. Each cab can be simultaneously extended to its outer transverse position. When the cabs are retracted to their innermost position no transverse beams or the like extend transversely outwardly of the chassis. There is no need for a plurality of stabilizing jacks to support the cabs relative to the floor during operation as the cabs may be rested upon the floor in any position and the tower for raising the drill pod is designed to automatically drop to engage the floor before the drill steel engages the mine roof.

It is a requirement of the mine safety laws that in most instances temporary roof supports must be positioned in front of a roof drilling and bolting device before the actual drilling and bolting process commences. Until recently, it has been necessary for miners to enter under the unbolted roof to place temporary roof support jacks. Some recent roof bolting devices propose extending the canopy generally positioned over the operator to engage the roof. This, of course, necessitates the repositioning of the roof support each time the operator's position is changed.

It is an advantage of the device set forth herein that a temporary roof support is carried by the chassis on a boom extending forwardly of the chassis and once the temporary roof support is positioned, it does not require repositioning during the repositioning of operator cabs transversely of the chassis.

SUMMARY OF THE INVENTION

Briefly, according to this invention, there is provided a roof drilling and bolting device comprising a mobile chassis which is supported by four independently driven wheels. The wheels are each hydraulically actuated and provide for the tramming of the chassis into the drilling and bolting position within a mine passageway. Two cabs are mounted to the front of the chassis for independent transverse (outward to the side) movement. Each cab has a floor or deck and a protective canopy. Extensible hydraulic devices are arranged to position the cab outwardly of the chassis. Other extensible hydraulic devices are arranged to move the cab vertically relative to the chassis, thus the cabs may be brought to rest upon the ground for the drilling and bolting operation or may be raised above the ground for tramming. Positioned in front of each cab are hydraulically actuated drilling assemblies including a rectilinear positioning device for the drill pod associated with said cab for moving the drill pod up-and-down and side-to-side in front of the cab. The bottom of the vertical towers of the positioning devices are, in any position, arranged over the mine floor without obstructions between the bottom and the mine floor. An extensible standard is positioned by a boom extending forward of the chassis. When the extensible standard is enlarged, it provides temporary roof support to protect the operators while drilling and bolting is taking place.

It is a preferred feature of this invention that all controls for hydraulic equipment positioned behind the cabs are electrically operated. It is a further preferred feature of this invention that two trays pivotally mounted to the chassis along the rearward edge of the trays and slidably mounted one to each of said cabs are accessible to workmen in the cabs at all lateral positions of the cab. Thus the drill steel and roof bolts may be laid upon the trays. It is a further preferred feature that the controls in one cab permit tramming of the mobile chassis and during a tramming mode, the cab positioning of both cabs is controlled from the same cab controlling the tramming. However, during drilling and bolting, each cab contains controls for independently positioning the cab within which the controls are associated.

DRAWINGS

Further features and other objects and advantages of this invention will become clear from the following detailed description made with reference to the drawings in which:

FIG. 1 is a schematic perspective view of a roof bolting device according to this invention, FIG. 2 is a schematic plan view of a roof bolting device according to this invention illustrating with phantom lines the outermost position of the right cab transversely of the chassis, FIG. 3 is a schematic side elevation of the roof bolting device according to this invention illustrating with phantom lines alternate positions of the canopy over the left cab and alternate positions of the vertical track or tower and the drilling pod, and FIG. 4 is a front elevation illustrating an alternate position of the cab outwardly of the chassis.

DESCRIPTION OF THE PREFERRED EMBODIMENT

Figure 1:
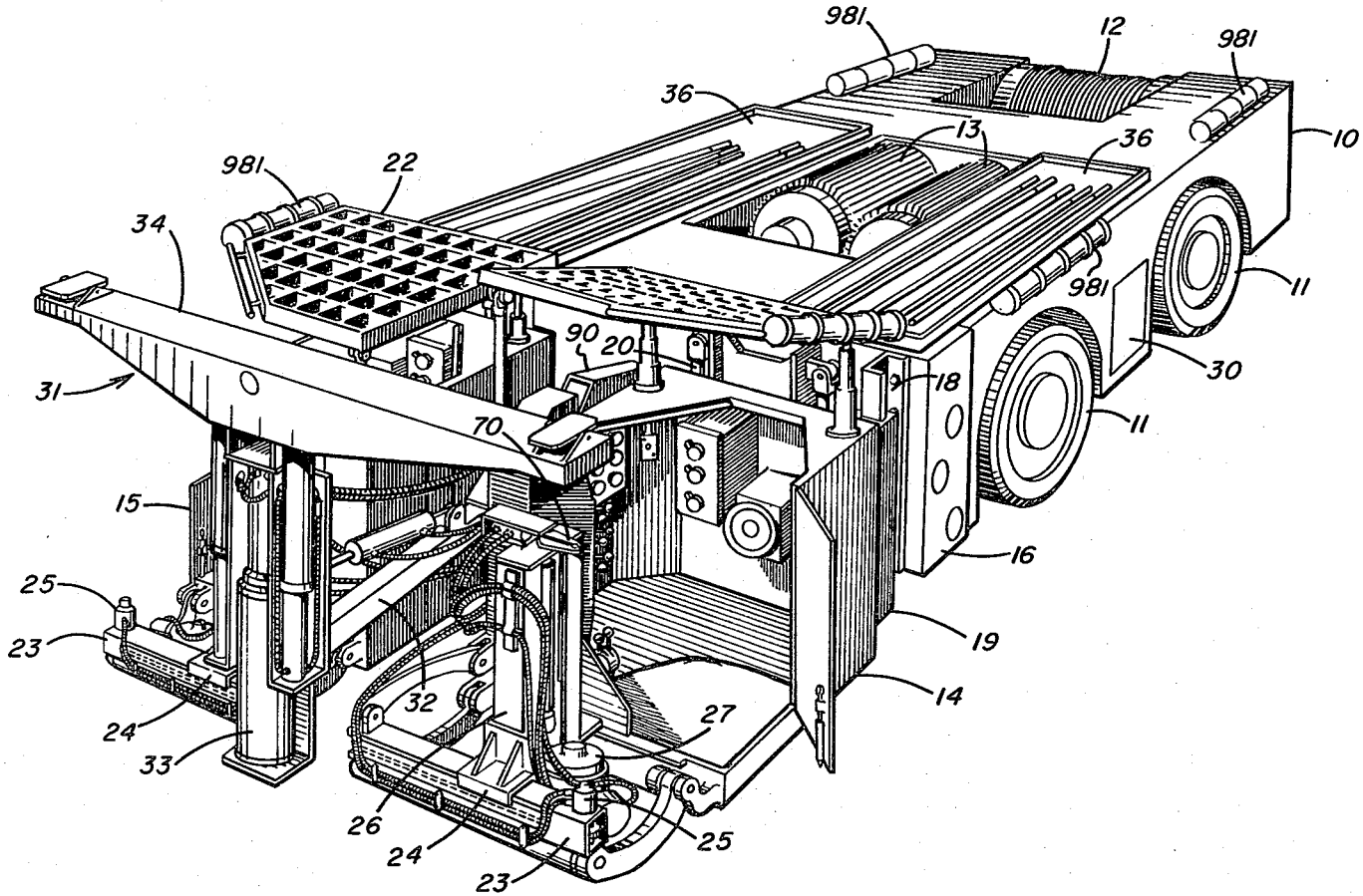

FIG. 1 is a perspective of a preferred embodiment of this invention. The roof drilling and bolting device comprises a mobile chassis 10 supported by four individually driven wheels 11. The chassis has a main electrical cable reel 12 mounted with a horizontal axis at the rear of the chassis. In the center of the chassis are two electrical motors 13 which drive the hydraulic pumps that provide hydraulic power to the entire device.

Cabs 14 and 15 are mounted to the front of the chassis 10. Certain details of the cab structure are disclosed in our co-pending application filed of even date herewith entitled "Cab For Roof Bolting Machine" bearing Ser. No. 030,220. The interface between the cabs 14 and 15 and the chassis 10 comprises two cab support brackets 16 (only one visible in FIG. 1) which are positionable transversely of the chassis 10 by hydraulic extensible devices (hydraulic piston-cylinder combinations) 17. The cab support brackets 16 support a vertical track 18 which slidably engages the runners 19 fixed to each cab. Extensible hydraulic devices 20 move each cab vertically relative to the cab support brackets to which they are fixed. The floor of each cab may be raised and lowered and each cab may be moved transversely. Each cab has a canopy 22 spaced above the floor. Certain details of the interface between the cab and the chassis are disclosed in our co-pending application filed of even date herewith entitled "Cab Mounting For Mining Machine" bearing Ser. No. 030,218.

A mounted track 23 extends the length along the front edge of the floor of each cab and is spaced therefrom. A carriage 24 is mounted on each track 23 and is hydraulically moved side-to-side in front of the cab by a hydraulic motor 25 which drives an orbiting chain. An upright tower 26 is mounted on each carriage 24. The bottom of the upright tower is directly above the mine floor without intervening apparatus. Associated with each upright tower 26 is a drill pod 27 for receiving drill steel and roof bolts. Extensible hydraulic means raise and lower the drill pods relative to the upright tower. The bottom of the upright tower automatically lowers to the mine floor before the drill steel engages the mine roof. The drill pod is observable and readily accessible from the cab in any of the positions it may assume by vertical movement of the pod relative to the tower and/or horizontal movement of the carriage relative to the track. Certain details of the pod positioning apparatus are disclosed in our co-pending application filed of even date herewith entitled "Rectilinear Positioning Device For Drilling Pod" bearing Ser. No. 030,221, now abandoned.

The drill pod 27 is well known and includes a chuck into which drill steel, roof bolt or roof bolt wrenches may engage. A hydraulic motor is connected to each drill pod and rotates whatever implement has been placed in the chuck. Secured to each drill pod is a dust hose leading to a blower. The drill steel typically are hollow and have openings near the tips thereof. The central opening in the drill steel communicates with the dust hose. During drilling, a blower draws dust and chunks created by the drilling through the drill steel, pod and dust hose and deposits the dust and chunks in dust boxes 30 accessible at the side of the chassis. The air from the dust boxes (minus the dust) then passes to respective mufflers (not shown) and then to the atmosphere.

A temporary roof support 31 comprises a boom 32 pivotally mounted to the chassis for movement in a vertical plane and is positioned in front of the roof bolting device. An extensible standard 33 is pivotally mounted to the boom 32. Atop the extensible standard is a transverse beam 34 for supporting the unbolted roof in front of the roof bolting machine. Certain details of the temporary roof support are disclosed in our co-pending patent application filed of even date herewith entitled "Vehicle Mounted Temporary Roof Support," bearing Ser. No. 030,217. Trays 36 are pivotally mounted to the chassis and to each of the cabs. Thus, in any transverse position of the cabs relative to the chassis, the drill steel and roof bolts laying upon the trays are accessible to an operator within the cab.

Figure 2:
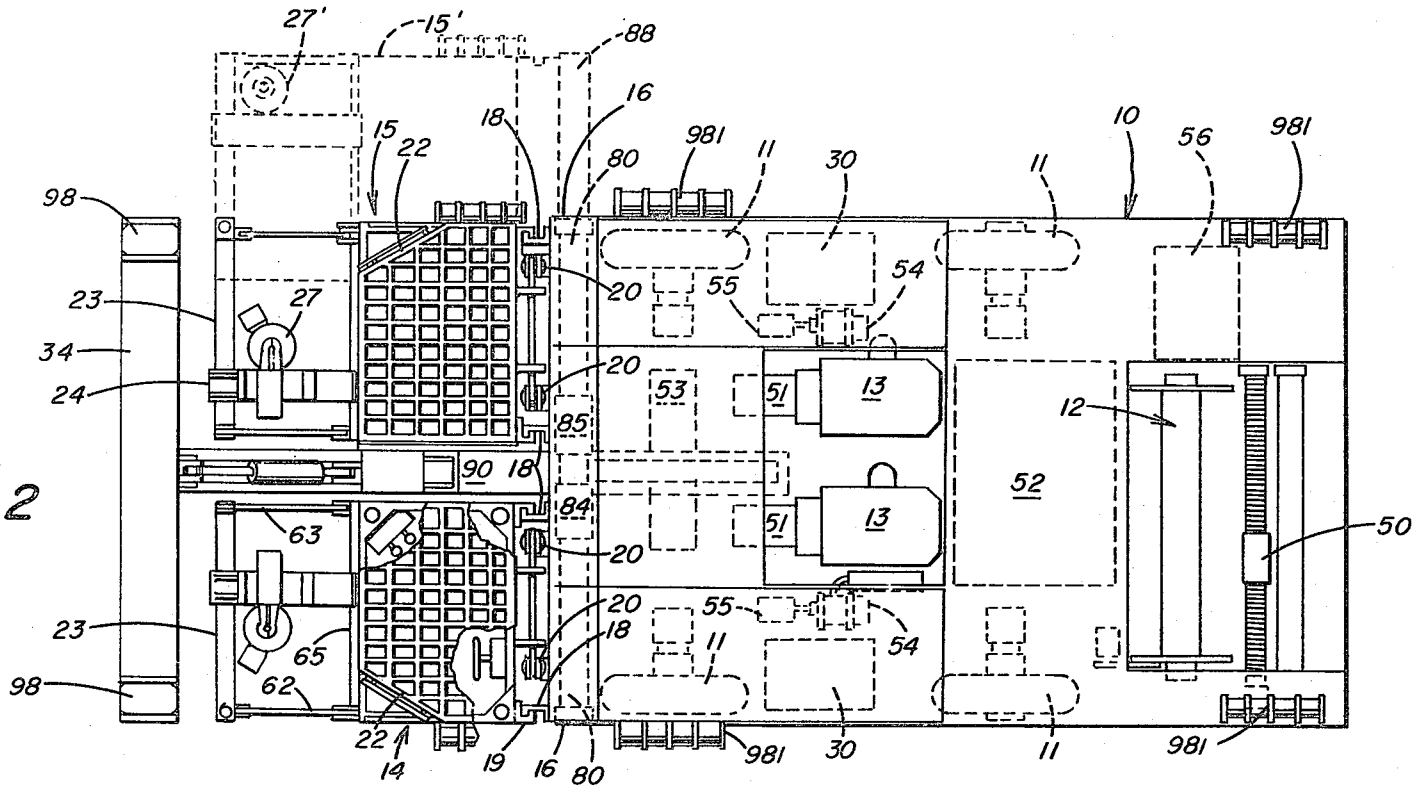

Referring now to FIG. 2, the overall layout of the roof bolting device is illustrated. The chassis 10 has a trailing cable reel 12 disposed near the rear and is provided with a cable guide mechanism 50 which lays the cable on the reel in a uniform fashion. The cable provides the electrical power for operating the entire roof drilling and bolting device. The mechanical actuation of most features of the device are hydraulically powered. Two large motors 13 drive hydraulic pumps 51 which supply the pressurized hydraulic fluid to extensible hydraulic devices and rotating hydraulic motors variously positioned on the device. The hydraulic reservoir 52 is located just behind the motors 13. In front of the motors is located the main hydraulic fluid control and distribution manifold 53 which is a bank of electrically controlled hydraulic valves for controlling most of the hydraulic work elements behind the cabs 14 and 15. Thus, it is not necessary to move the hydraulic control valves for tramming and cab positioning and associated hydraulic cables into the cabs. It is merely necessary to provide electrical control wires between the cabs and the hydraulic fluid control and distribution manifold 53.

Four individually driven and controlled wheels 11 are positioned with the front wheels adjacent the front of the chassis and the rear wheels centrally located relative to the chassis. The front wheels are positioned near the front of the chassis to support the load hanging there. The positioning of the rear wheels in the center of the chassis is a matter of compromise: specifically, the further apart the front and rear wheels, the more scuffing during the squirm steering of the vehicle, the closer together, the less stabile the ride during tramming.

When the temporary roof support and cabs are added, the weight upon the chassis is balanced in a way that the roof bolting device does not tip forward over the axis joining the front wheels. Because each wheel is individually driven and the axles do not pivot, drag or squirm steering is used in the embodiment illustrated. Other steering schemes would, of course, be acceptable.

The drilling dust collector system is conveniently placed between the front and rear wheels on each side of the vehicle. It comprises hydraulic motors 54 and associated blowers 55 which draw the drill dust to the dust boxes 30.

The entire vehicle is provided with an "intrinsically safe" electrical system. This means that the electrical cables, switches, motors, lights and electrically actuated hydraulic valves are all shielded in a way to satisfy government regulations. Near the rear of the vehicle is explosion-proof metal containers 56 which contain certain portions of the electrical circuit which are not deemed "intrinsically safe."

The operator cabs 14 and 15 are illustrated with grating type canopies 22 which offer protection from large falling debris but permit observation of the surrounding roof. It is permissible to provide solid canopies which afford greater protection from falling debris but make observation more difficult.

The right cab 15 is shown (in FIG. 2) in an alternate transversely extended position 15'. Also, the position of the drill pod 27 is shown at its most rightward position 27' relative to the right cab 15'. This establishes the outermost reach of the drill pod on the right side of the vehicle.

Each cab has a floor 58 and protective walls 59. Horizontal track 23 extends along the front of each cab secured to the cab by lever arms 62 and 63. Hence rotation of the arms 62 and 63 does not cause rotation of the track 23 relative to the cab. Mounted on the track and carried thereby is carriage 24 for the vehicle tower 26. Hence rotation of arms 62 and 63 does not change the direction of the axis of the tower 26. When the arms 62 and 63 are moved to their most downward position, the tower 26 also rests upon ledge or horizontal track 65 along the front of the cab. It may also be desirable to provide stops which limit the downward swing of the arms. The horizontal track 23 is preferably a beam (either a box beam or an I beam) with sprockets journaled at each end thereof. A chain is orbited about the sprockets in the beam. One sprocket is driven by hydraulic motor 25. The carriage 24 is fixed to the chain at one location and thus the carriage 24 is hydraulically driven along the front of the cab to a desired drilling location.

The front of the canopy 22 for each cab can be tilted upward to position 22' (see FIG. 3) to increase the operator's view of the work area.

The drill pod for each cab is mounted on a carriage that rides a trackway in the respective tower 26. The drill pod can thus be moved up and down hydraulically and the pod 27 is shown in an alternate upward position 27' (see FIG. 3). A platform 68 is supported from the tower and moves upward at one-half the rate of the drill pod. The platform 68 is shown in an alternate upward position 68' (see FIG. 3). The platform 68 supports a drill steel stabilizer 70 which guides the steel vertically and is always approximately one-half the distance between the drill pod and the mine roof.

The hydraulic controls for operating and positioning the drill pod in front of each cab are positioned in that cab. The canopy is also controlled from the cab over which it is positioned. The cab position itself is controlled by controls located in that cab. Tramming controls are only located in cab 14. A duplicate set of cab positioning controls (up-down and canopy only) for cab 15 are located in cab 14.

Figure 4:
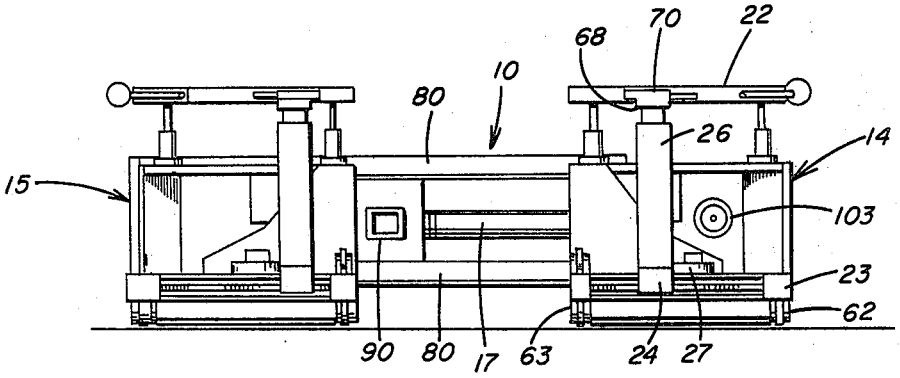

Between the chassis 10 and the cabs 14 and 15 are means for shifting each cab transversely, for example, as the cab 15 is shown in its alternate position 15' (see FIG. 2). Two large diameter tubes 80 (see FIG. 4) are mounted to the front of the chassis parallel to each other and generally parallel to the base of the chassis. A cab support bracket 16 for each cab slidably engages the outer cylindrical surface of the tubes 80. Specifically, arms 84 and 85 (see FIG. 2) extend from the cab support brackets 16 slidably engaging the outer surface of the large diameter tubes 80. Smaller diameter tubes slide within the large diameter tube 80. One smaller diameter tube 88 is visible in FIG. 2 where the right cab is shown in an alternate position. The cab brackets 16 in addition to being supported by arms 84 and 85 that slide over large diameter tubes 80, are also fixed to the outer ends of the smaller diameter tubes 88. When the smaller diameter tubes are extended out of the larger diameter tubes they become cantilever supports for the cabs. Extensible hydraulic devices 17 (see FIG. 4) are mounted on one end to the front face of the chassis and on the other end to the cab brackets 16 for moving the cab brackets 16 and thus cabs 14 and 15 in and out to the side.

Figure 3:
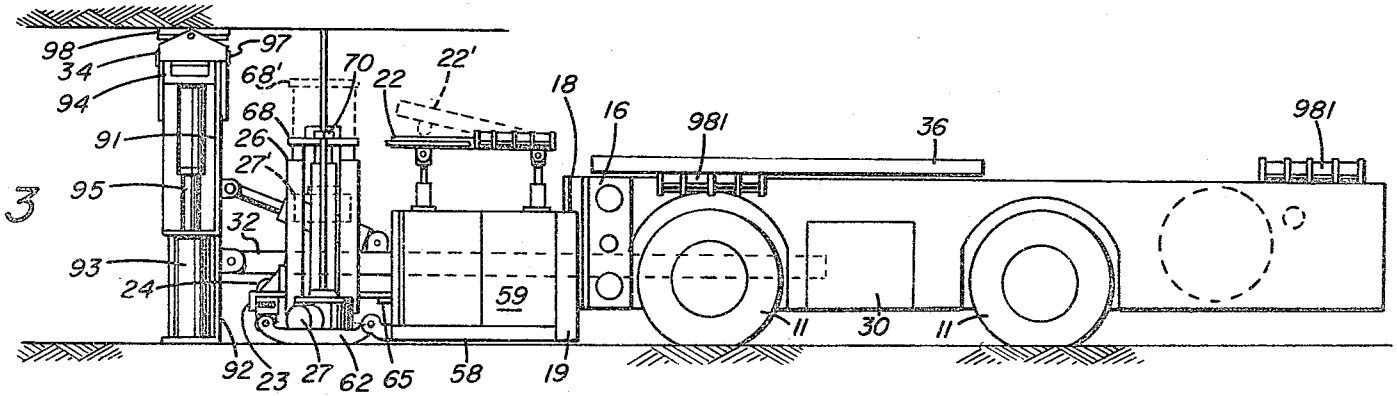

Mounted on the cab brackets 16 are vertical rails 18. As shown in FIG. 3, there are two rails fixed to each cab bracket. Runners 19 fixed to each cab engage the vertical rails 18 for guiding the cabs up and down. Extensible hydraulic devices 20 (see FIG. 1) are secured to the upper end of the cab and at the lower end to the cab brackets. Retraction of the hydraulic devices lowers the cab relative to the chassis. The cab is shown at its lowermost position in FIG. 3; that is, the position engaging the mine floor at the time of drilling and bolting.

The vertical and horizontal positioning controls for each cab are placed within each cab. These are electrical switches which activate hydraulic valves in the hydraulic fluid control and distribution manifold 53. However one cab 14 also contains controls for tramming and controls for the temporary roof support (described hereafter) and contains a duplicate set of controls for operating the vertical cab positioning device and canopy of the other cab. However, a lockout switch in the cab without the tramming controls can prevent the operator of the other cab from controlling the cab position or canopy.

In this way, one operator can position both cabs for tramming and can tram the vehicle into the appropriate position for drilling and bolting.

A temporary roof support 31 is carried by a boom 32 that extends forward of the roof bolting machine. The boom 32 is pivotally mounted to the chassis for swinging in a vertical plane. Guides 90 maintain the boom 32 in the vertical plane. On the end of the boom is an extensible standard 33 pivotally mounted thereto. The standard has a principal beam 91 to which the boom 32 is connected. The standard has a downward sliding section 92 and a large extensible hydraulic device 93 for moving the principal beam 91 and the section 92 apart. The standard also has an upward sliding section 94 and a pair of extensible hydraulic devices 95 for moving the principal beam 91 and the upward sliding section 94 apart. Thus by operation of extensible hydraulic devices 93 and 95, the standard is extensible to more than double its compressed height. The upward riding section 94 supports a fulcrum upon which a transverse beam 34 is pivoted at 97 for restricted angular movement. Preferably, pivotally mounted pads 98 are placed at the extremities of the transverse beam 34. The angle between the standard and the boom may be adjusted by an extensible hydraulic device.

Some of the lights 981 for illuminating the space around the vehicle are shown in the drawing. Others have not been shown to avoid cluttering the drawings.

OPERATION

The operation of the roof bolting machine as described above is as follows. After a passageway has been mined to a predetermined length, for example by a continuous miner, the passageway is cleared of other vehicles and the roof drilling and bolting device is brought into position under the unbolted roof in the center of the passageway. The temporary roof support is then positioned by the operation of the extensible hydraulic devices expanding the standard to cause the transverse beam to approach the mine roof. The angle between the standard and the boom is adjusted to keep the standard in a substantially upright position. Thereafter the roof support is brought into full engagement with the mine roof and the hydraulic valve controlling the extensible hydraulic devices in the standard are locked to prevent leakage and slippage. At this time, the roof drilling and bolting commences. Particular order of placement of roof bolts across the passageway is a matter of choice. The operators might simply drop both cabs to the floor in their centermost (tramming) position and commence placing the centermost roof bolts. As it becomes necessary, each operator may independently raise his cab from the floor and extend it to an outward position for placing roof bolts further from the center line. At no time is it necessary for the roof bolting operators to leave the cabs and/or enter the space under unbolted roofs.

Having thus defined our invention with the particularitiy and as required by the Patents Laws, what is desired protected is set forth in the following claims.

We claim:

1. A roof drilling and bolting device comprising a mobile chassis comprising a frame extending to and supporting a front edge, said frame not extending forwardly of said front edge, two operator cabs having floors and canopies, telescoping means secured to the front edge comprising at least one large tubular member and at least two extensible members telescoped with said large tubular member for slidably supporting the operator cabs on the front edge of the chassis, said extensible members each collapsible within the nominal width of the chassis, said extensible members extendible outwardly of the normal width of the chassis to support said cabs laterally outwardly of the nominal width of the chassis, said extensible members being independently actuatable to independently position said cabs, and drilling assemblies associated with each cab including a drill pod and means for rectilinearly positioning the drill pods up-and-down and side-to-side in front of the cabs.

2. A device according to claim 1 further comprising an extensible standard positionable by a boom extending forward of the chassis for providing temporary roof support.

3. A device according to claim 1 or 2 wherein the drill pods and means for positioning the drill pods are actuated by hydraulic devices and further comprising electrically operated controls for all said devices positioned behind the cabs.

4. A device according to claim 1 or 2 further comprising two trays, each pivotally mounted to the chassis along its rearward edge and slidably mounted to one of said cabs, such that the trays are accessible to workmen in the cabs at all lateral positions of the cab.

5. A device according to claim 1 in which the telescoping means for supporting the operator cabs further comprises means for raising and lowering the operator cabs.

6. A roof drilling and bolting device comprising a mobile chassis comprising a frame extending to and supporting a front edge, said frame not extending forward of said front edge, two operator cabs having floors and canopies, telescoping means secured to the front edge comprising at least one large tubular member and extensible members telescoped within the large tubular member for slidably supporting the operator cabs on the front edge of the chassis, said extensible members each collapsible within the nominal width of the chassis, said extensible members extendible outwardly of the nominal width of the chassis to support said cabs laterally outward of the normal width of the chassis, said extensible members being independently actuatable to independently position said cabs, said means for slidably supporting the cabs comprising means for raising and lowering said cabs, means for raising at least the front edge of the said canopies, drilling assemblies associated with each cab including a drill pod, means for rectilinearly positioning said drill pod up-and-down and side-to-side along the front edge of the cab, and a temporary roof support positioned by a boom extending forwardly of the front edge of the chassis.

* * * * *